US010513864B2

(12) United States Patent
Stoltz

(10) Patent No.: US 10,513,864 B2
(45) Date of Patent: Dec. 24, 2019

(54) STEERING SYSTEM FOR POOL CLEANERS

(71) Applicant: NC Brands L.P., Norwalk, CT (US)

(72) Inventor: Herman Stoltz, Port Elizabeth (ZA)

(73) Assignee: NC Brands L.P., Norwalk, CT (US)

( * ) Notice: Subject to any disclaimer, the term of this patent is extended or adjusted under 35 U.S.C. 154(b) by 390 days.

(21) Appl. No.: 15/367,853

(22) Filed: Dec. 2, 2016

(65) Prior Publication Data

US 2017/0159311 A1 Jun. 8, 2017

Related U.S. Application Data

(60) Provisional application No. 62/261,895, filed on Dec. 2, 2015.

(51) Int. Cl.
*E04H 4/16* (2006.01)

(52) U.S. Cl.
CPC ..... *E04H 4/1672* (2013.01); *E04H 4/1654* (2013.01)

(58) Field of Classification Search
CPC ..... E04H 4/16; E04H 4/1654; E04H 4/1663; E04H 4/1672; E04H 4/1681
USPC ..... 15/1.7; 4/490; 210/167.1, 167.15, 210/167.16, 167.18
See application file for complete search history.

(56) References Cited

U.S. PATENT DOCUMENTS 4,550,463 A * 11/1985 Raubenheimer ..... B63B 59/08 134/166 R
6,581,232 B1 6/2003 Chandler
2005/0251935 A1 11/2005 Grobler
2008/0092322 A1 4/2008 Halle

FOREIGN PATENT DOCUMENTS

WO WO9851888 11/1998
WO 2004/097145 * 11/2004
WO WO2007141739 12/2007

OTHER PUBLICATIONS

PCT International Searching Authority: International Search Report and Written Opinion dated Feb. 17, 2017; entire document.

* cited by examiner

*Primary Examiner* — Mark Spisich
(74) *Attorney, Agent, or Firm* — Allen Dyer Doppelt & Gilchrist

(57) ABSTRACT

A pool cleaner assembly includes a pool cleaner body supported for motion over an underwater pool surface, the pool cleaner body defining a water source connection and a suction opening on a lower surface thereof through which debris is removed from the underwater pool surface. The assembly further includes a steering device having a first steering device end configured for connection to a water hose and a second steering device end connected to the water source connection of the pool cleaner body, the steering device being operable to generate relative rotational motion between the first and second steering device ends.

12 Claims, 5 Drawing Sheets

STEERING SYSTEM FOR POOL CLEANERS

CROSS-REFERENCE TO RELATED APPLICATION

This application claims the benefit of U S. Provisional Patent Application Ser. No. 62/261,895, filed on Dec. 2, 2015, the contents of which are herein incorporated by reference in their entirety.

FIELD OF THE INVENTION

The present invention relates to a steering mechanism and more particularly, to a steering mechanism for pool cleaner.

BACKGROUND OF THE INVENTION

Automated pool cleaners without an active steering mechanism tend to repeat the same pattern of motion throughout the pool environment. For this reason it can be difficult for an automated cleaning device to adequately clean the entire floor of a pool. Moreover, such pool cleaners are often more prone to become stuck in a difficult area of the pool. Some methods have been developed to overcome these problems. A return water flow jet, for example, can be adjusted to influence the connecting hose of a pool cleaner. Another approach is to employ a rotating connecting hose. These methods have however, been found to be of rather limited value. A more effective steering mechanism for pool cleaners to improve cleaning coverage and efficiency is therefore desirable.

SUMMARY OF THE INVENTION

In view of the foregoing, it is an object of the present invention to provide a steering mechanism for pool cleaners. A pool cleaner assembly includes a pool cleaner body supported for motion over an underwater pool surface. The pool cleaner body defines a water source connection and a suction opening on a lower surface thereof through which debris is removed from the underwater pool surface. The assembly further includes a steering device having a flat steering device end configured for connection to a water hose and a second steering device end connected to the water source connection of the pool cleaner body. The steering device is operable to generate relative rotational motion between the first and second steering device end.

The steering device includes a steering device body, a driving unit configured to convert water flow through the steering device body to rotational motion, and a program gear assembly driven by the driving unit and generating the relative rotational motion between the first and second steering device ends.

A method of steering a pool cleaner using a steering device includes connecting the steering device between a water hose and a water source connection of the pool cleaner. Water flow is initiated through the steering device, water hose and pool cleaner. The water flow through the steering device is used to generate relative rotational motion between first and second steering device ends connected to the water hose and the water source connection of the pool cleaner, respectively.

These and other objects, aspects and advantages of the present invention will be better understood in view of the drawing and following detailed description of preferred embodiments.

DETAILED DESCRIPTION OF PREFERRED EMBODIMENTS

Figure 1:
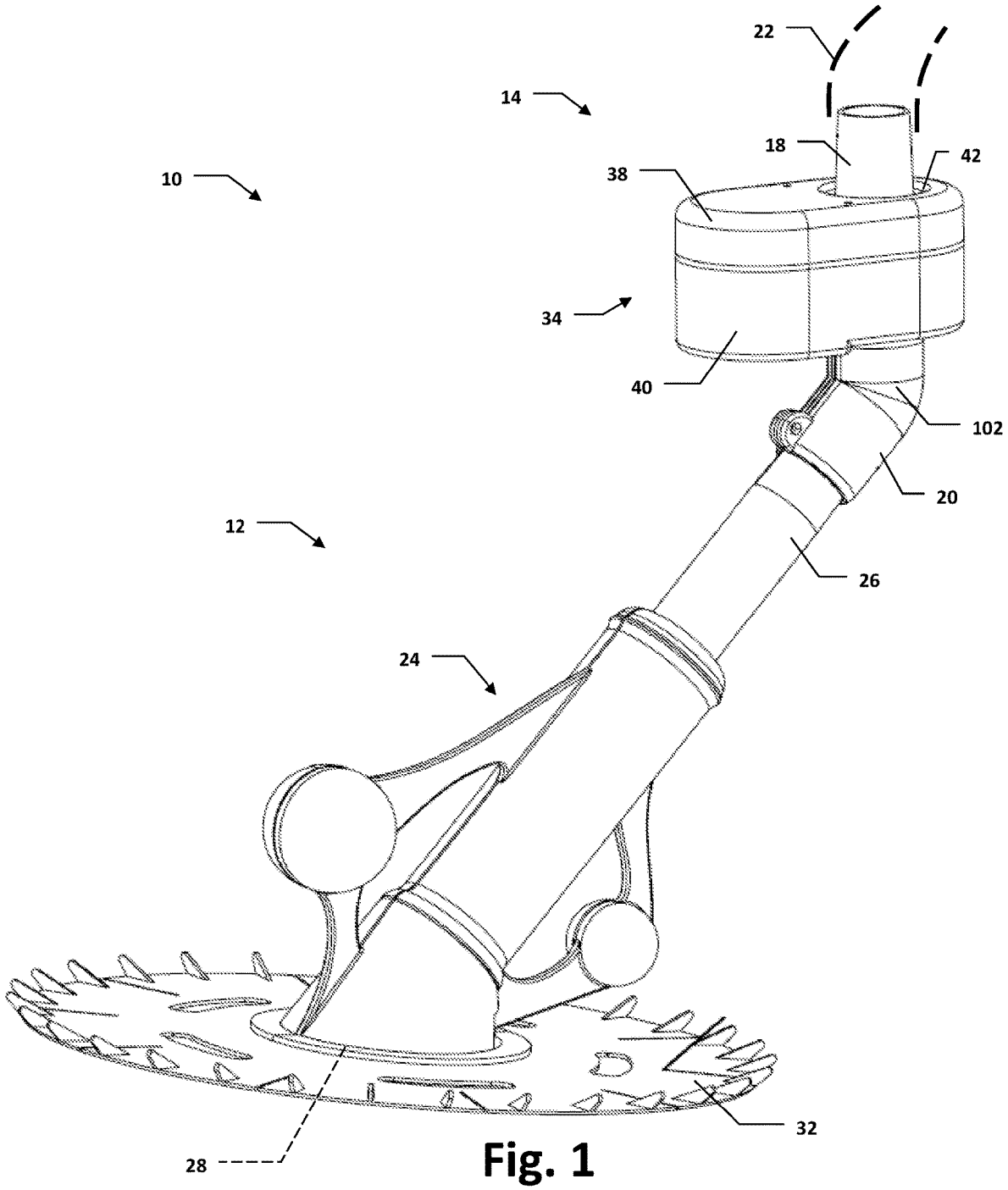
FIG. 1 is a perspective view of a pool cleaner assembly including a steering device attached to a pool cleaner, according to an embodiment of the invention.

Referring to FIG. 1, according to an embodiment of the present invention, a pool cleaner assembly 10 includes a pool cleaner 12 and a steering device 14. The steering device 14 has rotatably connected first and second steering device ends 18, 20 arranged between the pool cleaner body 12 and a water hose 22. The steering device 14 is operable to use water flow passing therethrough to generate relative rotational motion between the first and second steering device ends.

The pool cleaner 12 includes a body 24 supported for motion over an underwater pool surface. The pool cleaner body 24 defines a water source connection 26 and on a lower surface thereof, a suction opening 28 through which debris, entrained in water, is removed from the underwater pool surface. In the depicted embodiment, the water source connection 26 is connected directly to the second steering device end 20. Notably, the steering device could be affixed to the pool cleaner body prior to sale (e.g., during manufacturing), or configured for connection to the water source connection of a pre-existing pool cleaner body. Additionally, the steering device could be connected indirectly to the water source connection; for example, via an additional length of water hose. When used with an existing cleaner, any swivel functionality built thereinto is preferably disabled such that the steering effect of the steering device is not undesirably counteracted. Additionally, the steering device could be connected indirectly to the water source connection; for example, via an additional length of water hose.

Generally, water-driven pool cleaners are of two types: suction-driven cleaners and pressure-driven cleaners. In the former, the water hose is connected to a water return connection of the pool circulation system and the water drawn in via the suction opening passes through the hose to the water return. In the latter, the water hose is connected to a water supply connection of the pool circulation system and water is drawn into the suction opening via suction forces typically induced via a venturi effect using the water flowing into the pool cleaner body from the water hose. The depicted pool cleaner 12 is a suction-driven cleaner, and more specifically, a suction-driven cleaner of the type supported for movement by a flexible disc 32 where intermittent interruption of suction flow via an internal diaphragm results in movement over pool surfaces. However, the present invention is not necessarily limited to use in connection, with such a cleaner, and could readily be applied with equivalent effect to other types of suction-driven cleaners as well as to pressure-driven cleaners. Additionally, elements used in the gearing of the depicted steering device 14 could be employed in internal steering mechanisms for pool cleaners and other devices, whether driven by water or other forces.

Figure 2:
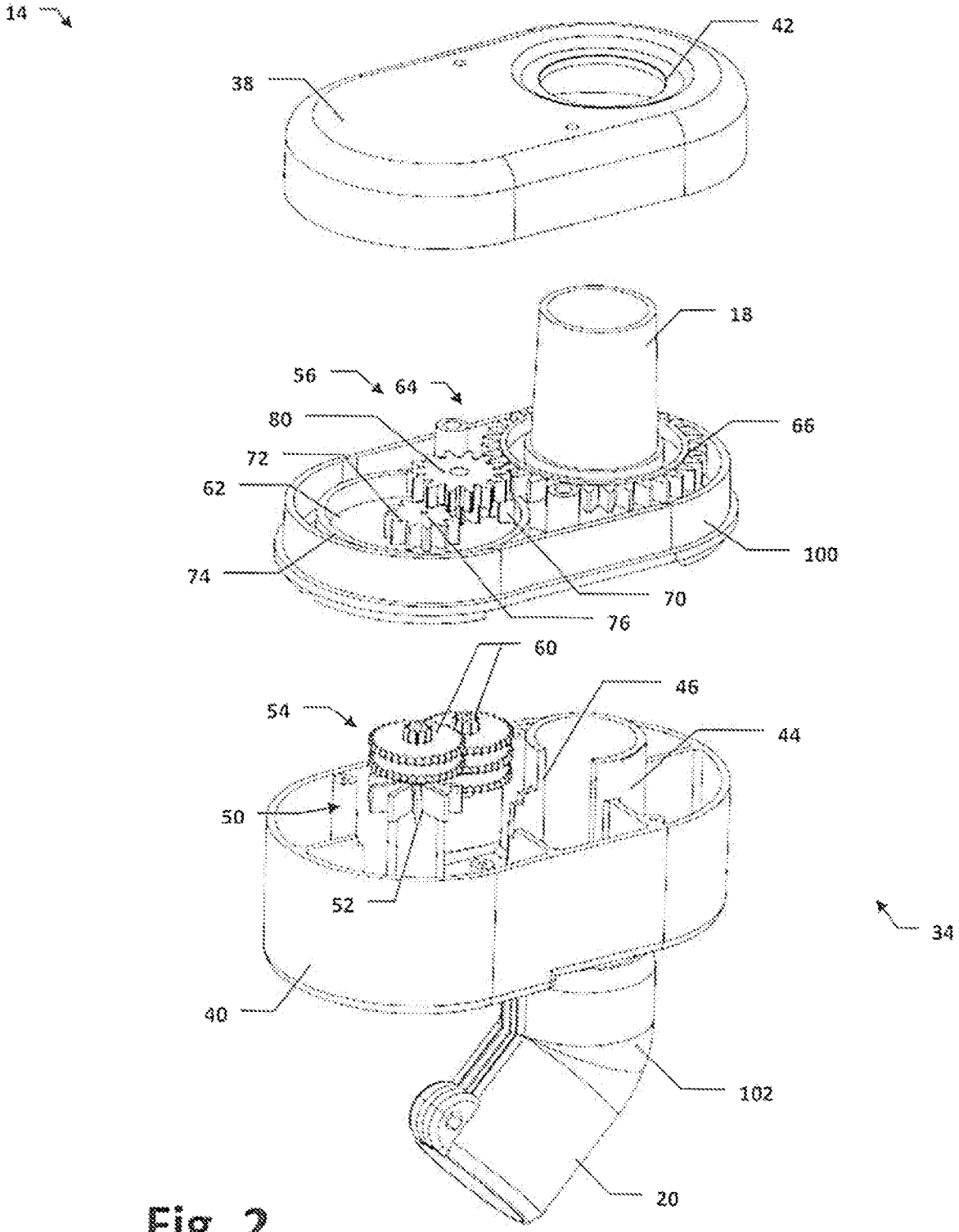
FIG. 2 is an exploded perspective view of the steering device of FIG. 1.

Referring also to FIG. 2, the steering device 14 includes a body 34, advantageously formed of first and second body sections 38, 40 to facilitate assembly. In the depicted embodiment, the first steering device end 18 is rotatably mounted within the body 34, extending through an opening 42 in the first body section 38, while the second steering device end 20 is fixed to the second body section. It will be appreciated that fixed and rotatable ends could be reversed or both ends could be rotatable relative to the steering device body.

A fluid passage 44 is defined in the body 34 extending between the first and second ends 18 and 20, allowing water to pass through the steering device 14 from the pool cleaner 12 to the water hose 22 (or vice versa). An internal opening 46 is defined in the fluid passage 44 within the body 34 allowing another flow path for water therethrough for driving a driving unit 50.

The driving unit 50 includes a shaft mounted water wheel 52 which generates rotational motion from the water flow through the steering device 14, in turn driving a timing assembly 54 and, a program gear assembly 56. The timing assembly 54 includes a plurality of gears 60 which reduce (or increase) the rotational speed generate by the drive unit to the rotational speed input to the program gear assembly 56.

Figure 3:
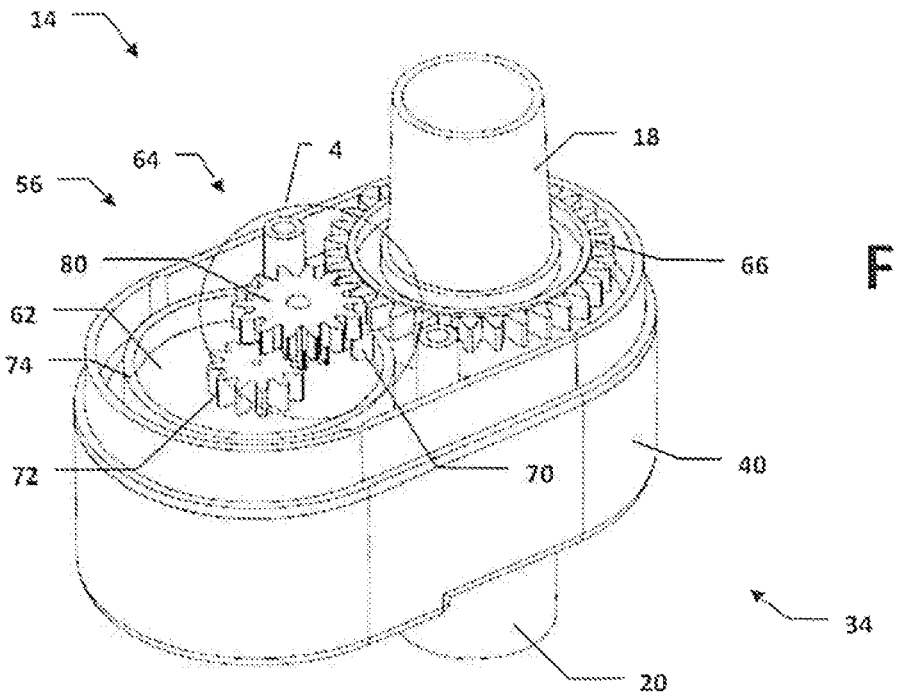
FIG. 3 is a perspective view of the steering device of FIG. 1 with a section removed to show details.
Figure 4:
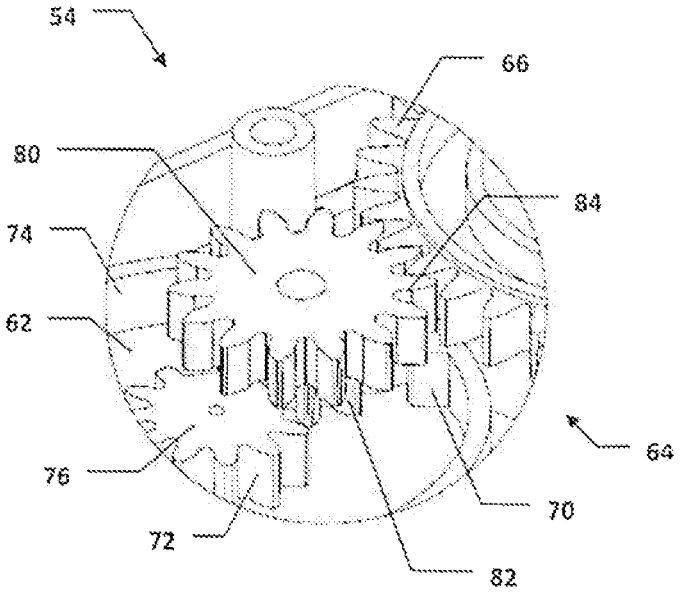
FIG. 4 is a detail view of area 4 of FIG. 3.

Referring also to FIGS. 3 and 4, the program gear assembly 56 includes a program gear 62, driven by the drive unit 50 via the timing assembly, and an output gear assembly 64, which imparts rotational motion to the first steering device end 18. In the depicted embodiment, the output gear assembly 64 drives the first steering device end 18 via a steering gear 66 formed therearound and rotatable therewith.

Figure 5:
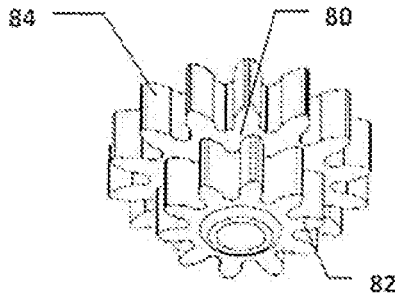
FIG. 5 is a perspective view of an output gear of the steering device of FIG. 1.

The program gear 62 includes a plurality of inwardly oriented teeth 70 and a plurality of outwardly oriented teeth 72. The inwardly oriented teeth 70 are arranged around a portion of an outer periphery 4, while the outwardly oriented teeth 72 are arranged around a portion of an inner periphery or hub 76. This arrangement permits a single output gear 80 to be used, positioned between the outer and inner peripheries 74, 76. The output gear 80 (best seen in FIG. 5) is a compound gear with first and second axially separated sets of teeth, 82, 84, with the first set 82 engaging the program gear 62 and the second set 84 engaging the steering gear 66.

Figure 6A:
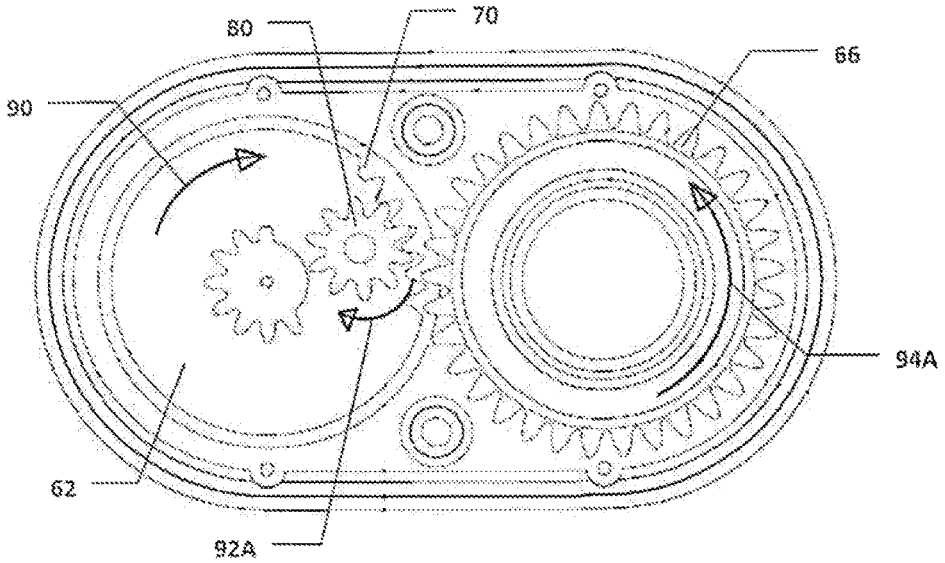
FIGS. 6A-6C are plan views of different operational states of the steering device of claim 1.
Figure 6B:
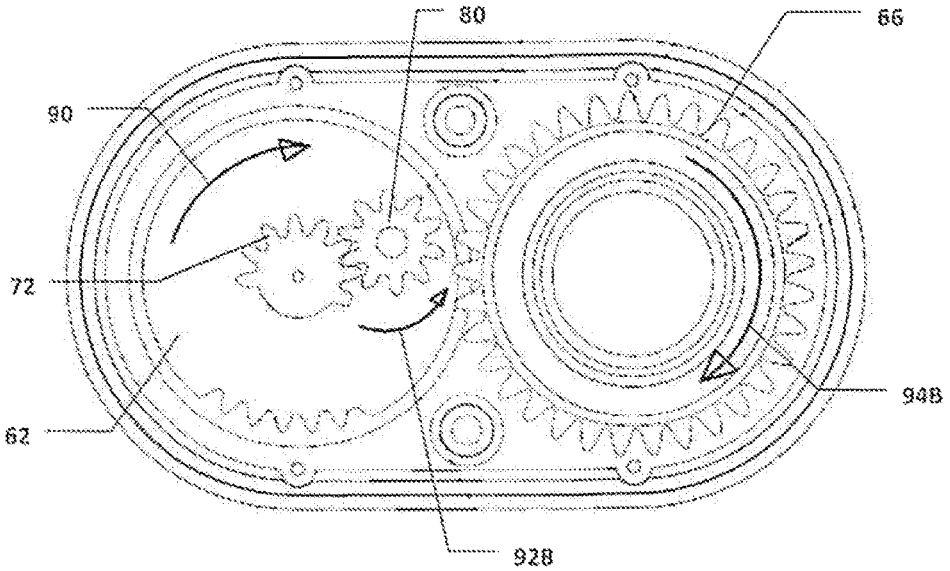
Figure 6C:
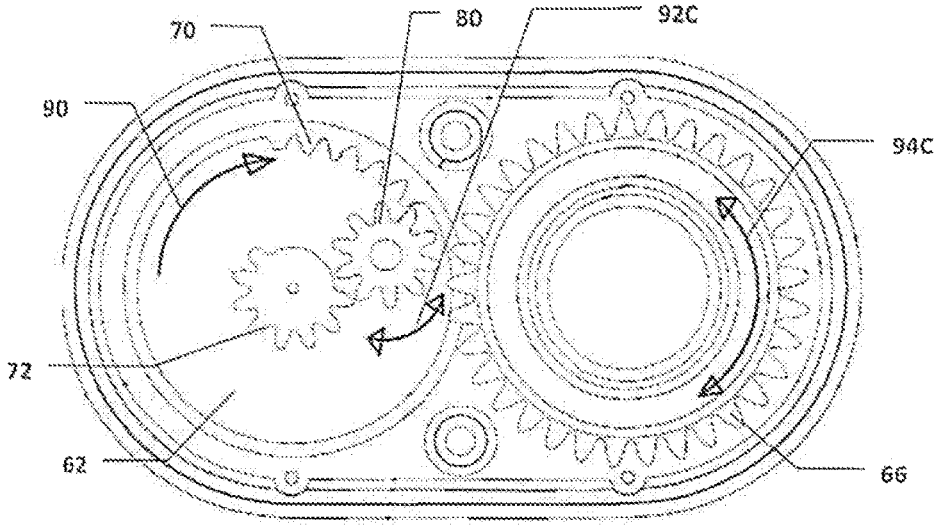

Referring to FIGS. 6A-6C, the program gear 62 is rotationally driven by the drive unit 50 (see FIG. 2) in a constant rotational direction (indicated by arrow 90). During a first portion of program gear 62 rotation (as in FIG. 6A), the output gear 80 engages the inwardly oriented teeth 70, and consequently is driven in a rotational direction (arrow 92A) matching the program gear 62, in turn driving the steering gear 66 (and first steering device end 18) in a rotational direction counter (arrow 94A) to the program gear 62.

During a second portion of program gear 62 rotation (as in FIG. 6B), the output gear 80 engages the outwardly oriented teeth 72, and is driven in a rotational direction (arrow 928) counter to the program gear 62, in turn driving the steering gear 66 in a rotational direction (arrow 94B) the same as the program gear 62. Thus, as the program gear 62 rotates, the direction of relative rotation, between the first and second steering device ends 18, 20 is automatically changed.

As seen in FIG. 6C, during a third portion of program gear rotation 62 (occurring between first and second portions) a period can be set where the output gear 80 is not driven by either set of program gear teeth 70, 72, and thus the output gear 80 and steering gear 66 are free to rotate in any direction (as represented by arrows 92C, 94C). During such period(s), the first and second steering device ends 18, 20 are free to rotate (or not rotate) relative to one another in a "neutral" phase of the steering device 14.

The arc length of rotation in each direction, as well as of any neutral phases, can be varied by varying the angular extends covered by the inwardly and outwardly oriented teeth 70, 72. In the depicted embodiment, the inwardly and outwardly oriented teeth 70, 72 are each grouped into a single segment with two neutral phases therebetween. However, the inwardly and outwardly oriented teeth could each be arranged in multiple separate segments.

The rotational speed in the different rotational directions is advantageously also varied. In the depicted embodiment, differing tooth counts and positions between the inwardly and outwardly oriented teeth 70, 72 result in a significantly different rotational, and counter-rotational speeds of the output gear 80 and the steering gear 66. Changing rotational speed as well as direction can further enhance the steering effect of the steering device 14, as well as assist in helping the pool cleaner 12 disengage itself from obstacles. Generally, the rotational durations and speeds are preferably selected such that the pool cleaner 12 will rotate through 360 degrees after multiple complete turns of the program gear 62.

The steering device body 34 advantageously also includes a mounting frame 100 sandwiched between the first and second body sections 38, 40. The mounting frame 100 supports the program gear assembly 56 and first end 18 above the drive unit 50 and second body section 40. An angled neck 102 advantageously connects the body 34 to the pool cleaner body 24, which allows the hose 22 to connect vertically to the first end 18, and perpendicularly to the surface underlying the pool cleaner 12. Other orientations could be used, but with the depicted pool cleaner 12, this orientation helps prevent the action of the steering device 14 from causing an undesirable break in traction between the pool cleaner 12 and the underlying pool surface.

Figure 7:
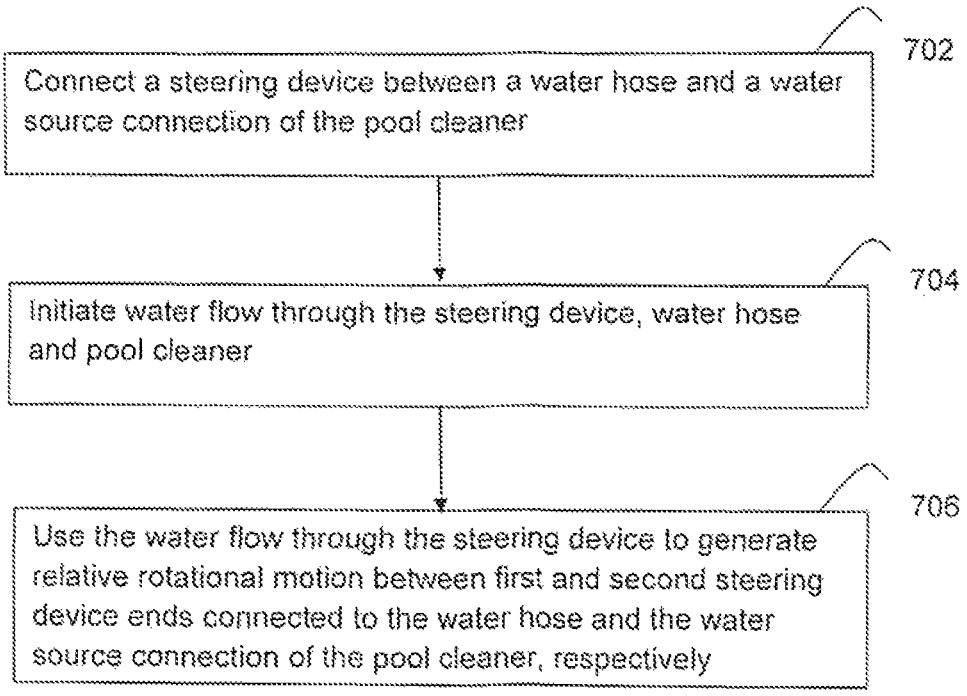
FIG. 7 is a flow diagram of a method of steering pool cleaner, according to a method aspect of the present invention.

FIG. 7 illustrates a method for steering a pool cleaner using a steering device 14. At step 702, the steering device 14 is connected between a water hose and a water source connection 14 of the pool cleaner 12. At step 704, water flow is initiated through the steering device 14, water hose and pool cleaner 12. At step 706, the water flow through the steering device 14 is used to generate relative rotational motion between first and second steering device ends 18 and 20 connected to the water hose and the water source connection of the pool cleaner, respectively. The water flow can move from the pool cleaner 12 to the water source or from the water source to the pool cleaner 12, depending the type of pool cleaner (e.g., suction driven, pressure driven).

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described.

What is claimed is:

1. A pool cleaner assembly comprising:

a pool cleaner body supported for motion over an underwater pool surface, the pool cleaner body defining a water source connection and a suction opening on a lower surface thereof through which debris is removed from the underwater pool surface; and a steering device having a first steering device end configured for connection to a water hose and a second steering device end connected to the water source connection of the pool cleaner body, the steering device being operable to generate relative rotational motion between the first and second steering device ends, a steering gear being fixedly coupled to one of the first and second steering device ends;

wherein the steering device includes:

a steering device body;

a driving unit configured to convert water flow through the steering device body to rotational motion; and a program gear assembly driven by the driving unit and generating the relative rotational motion between the first and second steering device ends;

wherein the program gear assembly is configured to automatically alternate the relative rotational motion between the first and second steering device ends between a first rotational direction and a second rotational direction counter to the first rotational direction; and wherein the program gear assembly includes:

a program gear having a plurality of inwardly oriented teeth and a plurality of outwardly oriented teeth; and an output gear assembly including at least one output gear, the output pear assembly arranged adjacent to the program gear such that during a first portion of program gear rotation, the output gear assembly is driven by the inwardly oriented teeth in the first rotational direction, and during a second portion of program gear rotation, the output gear assembly is driven by the outwardly oriented teeth in the second rotational direction and being engaged with the steering gear.

2. The pool cleaner assembly of claim 1, further comprising a water hose connected to the second steering device end.

3. The pool cleaner assembly of claim 1, wherein the inwardly oriented teeth extend inwardly from an outer periphery of the program gear, and the outwardly oriented teeth extend outwardly from an inner periphery of the program gear, the at least one output gear being arranged between the outer and inner peripheries so as to engage the inwardly oriented teeth during the first portion of program gear rotation, and to engage the outwardly oriented teeth during the second portion of the program gear rotation.

4. The pool cleaner assembly of claim 1, wherein the at least one output gear is a compound gear including first and second axially separated sets of teeth, the first set of teeth engaging the program gear, the second set of teeth engaging the steering gear.

5. The pool cleaner assembly of claim 1, during a third portion of program gear rotation, the output gear assembly is not driven by either the inwardly oriented teeth or the outwardly oriented teeth.

6. The pool cleaner assembly of claim 5, wherein the first and second steering device ends are freely rotatable relative to one another during the third portion of program gear rotation.

7. The pool cleaner assembly of claim 1, wherein the program gear assembly is configured such that rotational speeds in the first and second rotational directions are different.

8. The pool cleaner assembly of claim 1, wherein a timing assembly is arranged between the driving unit and the program gear assembly, the timing assembly being configured to convert a first rotational speed of the driving unit to a second rotational speed of the program gear assembly.

9. The pool cleaner assembly of claim 1, wherein the pool cleaner body is configured such that water introduced through the suction opening is discharged via the water source connection.

10. The pool cleaner assembly of claim 9, further comprising a flexible disc arranged around the suction opening and supporting the pool cleaner body for motion over the underwater pool surface.

11. The pool cleaner assembly of claim 1, wherein the steering device is connected directly to the water source connection of the pool cleaner body.

12. A pool cleaner assembly comprising:

a pool cleaner body supported for motion over an underwater pool surface, the pool cleaner body defining a water source connection and a suction opening on a lower surface thereof through which debris is removed from the underwater pool surface; and a steering device having a first steering device end configured for connection to a water hose and a second steering device end connected to the water source connection of the pool cleaner body, the steering device being operable to generate relative rotational motion between the first and second steering device ends;

wherein the steering device includes:

a steering device body;

a driving unit configured to convert water flow through the steering device body to rotational motion; and a program gear assembly driven by the driving unit and generating the relative rotational motion between the first and second steering device ends;

wherein the program gear assembly is configured to automatically alternate the relative rotational motion between the first and second steering device ends between a first rotational direction and a second rotational direction counter to the first rotational direction;

wherein the program gear assembly includes:

a program gear having a plurality of inwardly oriented teeth extending along a first angular extent of an outer periphery of the program gear and a plurality of outwardly oriented teeth extending along a second angular extent of an inner hub of the program gear; and an output gear assembly including at least one output gear, the output gear assembly arranged adjacent to the program gear such that during a first portion of program gear rotation, the output gear assembly is driven by the inwardly oriented teeth in the first rotational direction, and during a second portion of program gear rotation, the output gear assembly is driven by the outwardly oriented teeth in the second rotational direction; and wherein the first and second angular extents are angularly offset such that none of the plurality of inwardly oriented teeth are located within the second angular extent and none the plurality of outwardly oriented teeth are located within the first angular extent.

* * * * *